US010696065B2

(12) United States Patent
Mombourquette et al.

(10) Patent No.: US 10,696,065 B2
(45) Date of Patent: Jun. 30, 2020

(54) PLATEN ASSEMBLY FOR TEXTILE DECORATING MACHINES

(71) Applicant: ColDesi Inc., Tampa, FL (US)

(72) Inventors: Mark Mombourquette, Treasure Island, FL (US); Brett Weibel, Seminole, FL (US)

(73) Assignee: ColDesi Inc., Tampa, FL (US)

( * ) Notice: Subject to any disclaimer, the term of this patent is extended or adjusted under 35 U.S.C. 154(b) by 0 days.

(21) Appl. No.: 16/027,723

(22) Filed: Jul. 5, 2018

(65) Prior Publication Data

US 2019/0009575 A1 Jan. 10, 2019

Related U.S. Application Data

(60) Provisional application No. 62/530,278, filed on Jul. 9, 2017.

(51) Int. Cl.

| | |
|---|---|
| ***B41J 3/407*** | (2006.01) |
| ***B41J 11/00*** | (2006.01) |
| ***B41J 11/06*** | (2006.01) |

(52) U.S. Cl.

CPC ..... *B41J 3/4078* (2013.01); *B41J 11/0085* (2013.01); *B41J 11/0095* (2013.01); *B41J 11/06* (2013.01)

(58) Field of Classification Search

CPC ..... B41J 11/0085; B41J 11/06; B41J 11/002; B41J 15/04

USPC ..... 347/16, 101, 102

See application file for complete search history.

(56) References Cited

U.S. PATENT DOCUMENTS

| | | | | |
|---|---|---|---|---|
| 6,068,374 A * | 5/2000 | Kurata | B41J 3/4078 | 347/100 |
| 8,675,243 B2 * | 3/2014 | Hyman | H04N 1/387 | 347/15 |
| 8,708,480 B2 * | 4/2014 | Toya | B41J 11/002 | 347/104 |
| 8,714,735 B2 * | 5/2014 | Kato | B41J 11/06 | 347/104 |
| 2007/0103529 A1 * | 5/2007 | Pearl | B41J 3/28 | 347/101 |

* cited by examiner

*Primary Examiner* — An H Do
(74) *Attorney, Agent, or Firm* — Dorton & Willis, LLP

(57) ABSTRACT

A platen assembly for use in digital printing includes a substrate support adapted to support the substrate thereon to facilitate printing to the substrate. One or more apertures are associated with the substrate support and the platen assembly includes a vacuum chamber in fluid communication with the one or more apertures. A vacuum device is in communication with the vacuum chamber such that vacuum pressure is developed in the vacuum chamber during operation of the vacuum device and a corresponding air flow is developed through the one or more apertures. A method for applying indicia to a textile substrate includes placing the textile substrate on a substrate support surface, and directing air through the textile substrate such that the substrate is drawn against the substrate support surface.

21 Claims, 9 Drawing Sheets

PLATEN ASSEMBLY FOR TEXTILE DECORATING MACHINES

CROSS-REFERENCE

This application claims the benefit of U.S. Provisional Patent Application Ser. No. 62/530,278, filed Jul. 9, 2017, the disclosure of which is incorporated by reference herein in its entirety

TECHNICAL FIELD

The present invention relates generally to direct-to-garment printing machines and support equipment and, more particularly, to a platen assembly for use with printing machines and pre- and post-printing equipment.

BACKGROUND

Digital printers have been developed to facilitate the application of graphics, text, and other indicia to flexible substrates, particularly textile materials used for garments such as T-shirts, sweatshirts, and various other garments or textile products wherein inks or other printing materials are applied directly to the substrate. In conventional digital printing systems, the textile substrate is supported on a platen that is moved by a print transport system beneath a print head assembly for the application of inks or pretreatment liquids to one or more portions of the substrate. To prevent the substrate from inadvertent unwanted movement on the platen, various securing mechanisms have been employed such as clamps, edge frames, and tacky surfaces. These conventional securing systems are generally cumbersome to use and are not well suited for accommodating substrates or even printable areas of varying size. A need exists for improved methods and apparatus for securing textile substrates to printer platens that overcome these and other drawbacks of the prior art.

SUMMARY

The present invention provides a platen assembly for use with substrates such as textile materials to facilitate the application of pre-treatment liquids and inks for digital printing of text, graphics and other indicia to the substrate. The platen assembly may also be used on processes where heat is applied to the substrate to cure and/or dry any such applied materials. In one aspect, a platen assembly in accordance with the present disclosure includes a substrate support adapted to support the substrate thereon to facilitate printing to the substrate. One or more apertures are associated with the substrate support and the platen assembly includes a vacuum chamber in fluid communication with the one or more apertures. A vacuum device is in communication with the vacuum chamber such that vacuum pressure is developed in the vacuum chamber during operation of the vacuum device and a corresponding air flow is developed through the one or more apertures. While the invention will be described in connection with certain embodiments, it will be understood that the invention is not limited to these embodiments. On the contrary, the invention includes all alternatives, modifications, and equivalents as may be included within the spirit and scope of the present invention.

In another aspect, the vacuum pressure developed by the vacuum device may be selectively adjusted between at least a first vacuum pressure and a second vacuum pressure that is lower or higher than the first vacuum pressure. The vacuum pressure level may be selected to optimize printing, pre-treating, or drying and curing operations performed on the substrate as described more fully herein. In another aspect, a method of applying indicia to a textile substrate includes placing the textile substrate on a substrate support surface, and directing air through the textile substrate such that the substrate is drawn against the substrate support.

The above and other objects and advantages of the present invention shall be made apparent from the accompanying drawings and the description thereof.

DETAILED DESCRIPTION

Figure 1:
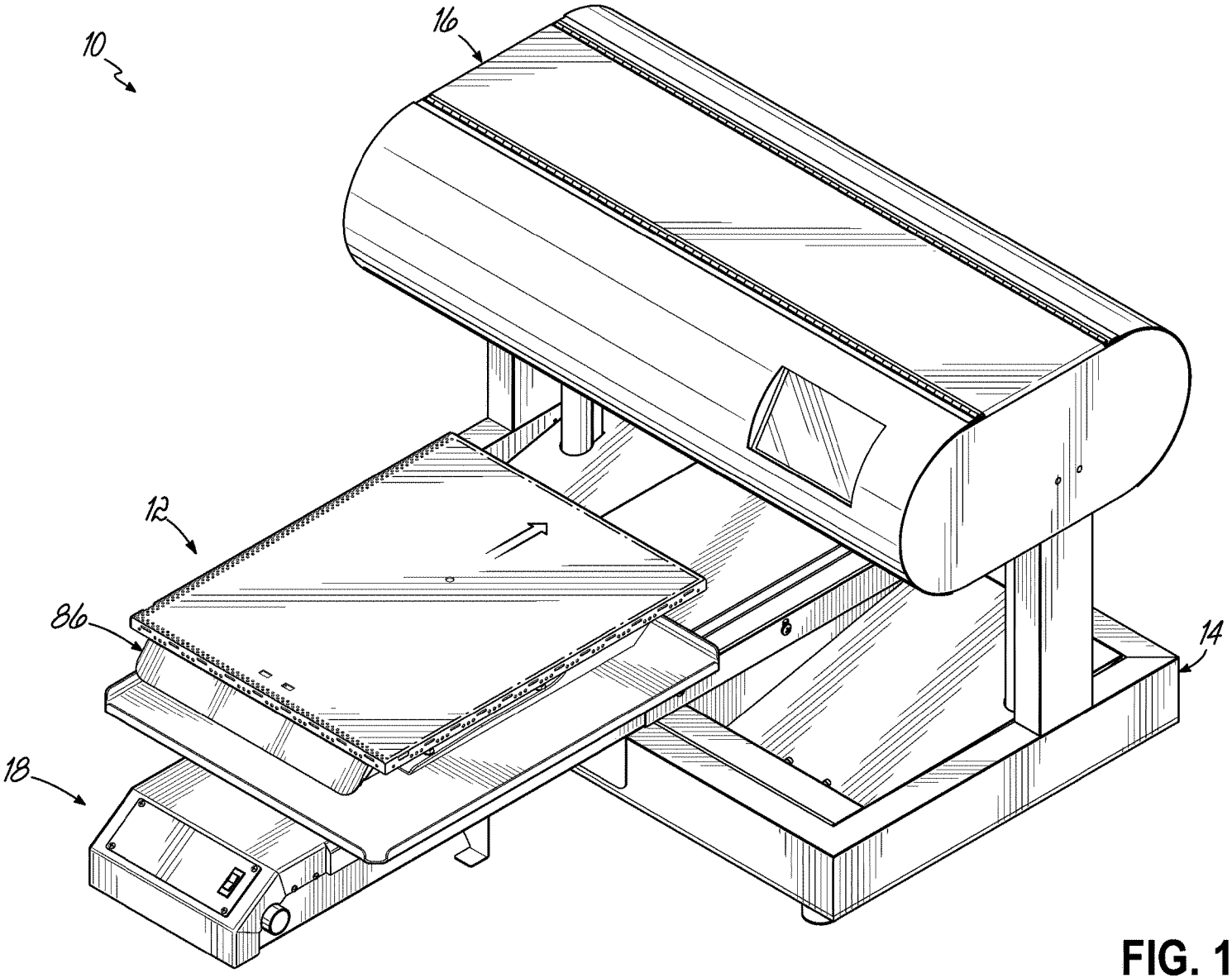
FIG. 1 is a perspective view of a typical digital printer system including an exemplary platen assembly in accordance with the principles of the present disclosure.

FIG. 1 depicts a digital printer system 10 which may be used for direct printing onto substrates such as garments and other textile materials. The digital printer system 10 includes an exemplary platen assembly 12 in accordance with the principles of the present disclosure. The digital printer system 10 may be configured to apply inks directly to the substrates to create images, text, or other indicia as known in the art. The exemplary platen assembly 12 may also be used during the application of pretreatment liquids to substrates, or during the curing of inks and/or pretreatment liquids on the substrates.

The digital printer system 10 includes a base 14 supporting a housing 16 that contains a printhead assembly or nozzles for applying inks or pretreatment liquids to a substrate. The platen assembly 12 with a substrate supported thereon is received on a transport assembly 18 configured to move the platen assembly 12 in a controlled manner beneath the housing 16 for application of the inks and/or pretreatment liquids. Alternatively, the platen assembly 12 may remain stationary while printing mechanisms of the printer system 10 are moved over the platen assembly 12 supporting a substrate thereon. With continued reference to FIG. 1 and referring further to FIGS. 2-4, the platen assembly 12 is shown in more detail. The platen assembly 12 includes a substrate support 20 and a plenum assembly 22 supported on a base 24 by first and second spaced apart legs 26*a*, 26*b*. As best seen in FIG. 4, the first and second legs 26*a*, 26*b* may include a recessed portion 28 that facilitates receiving certain substrates S, such as T-shirts or sweatshirts onto the platen assembly 12 for printing purposes. In the embodiment shown, the base 24 comprises a bottom wall 30 to which the first and second legs 26*a*, 26*b* are attached by fasteners 32, for example. The base 24 may further include one or more peripheral sidewalls 34 provided along all or a portion of the peripheral edges of the bottom wall 30. The base 24 may be configured to couple with the transport assembly 18 of the printer system 10 whereby the transport assembly 18 may be operated to control movement of the platen assembly 12 relative to the housing 16.

Figure 3:
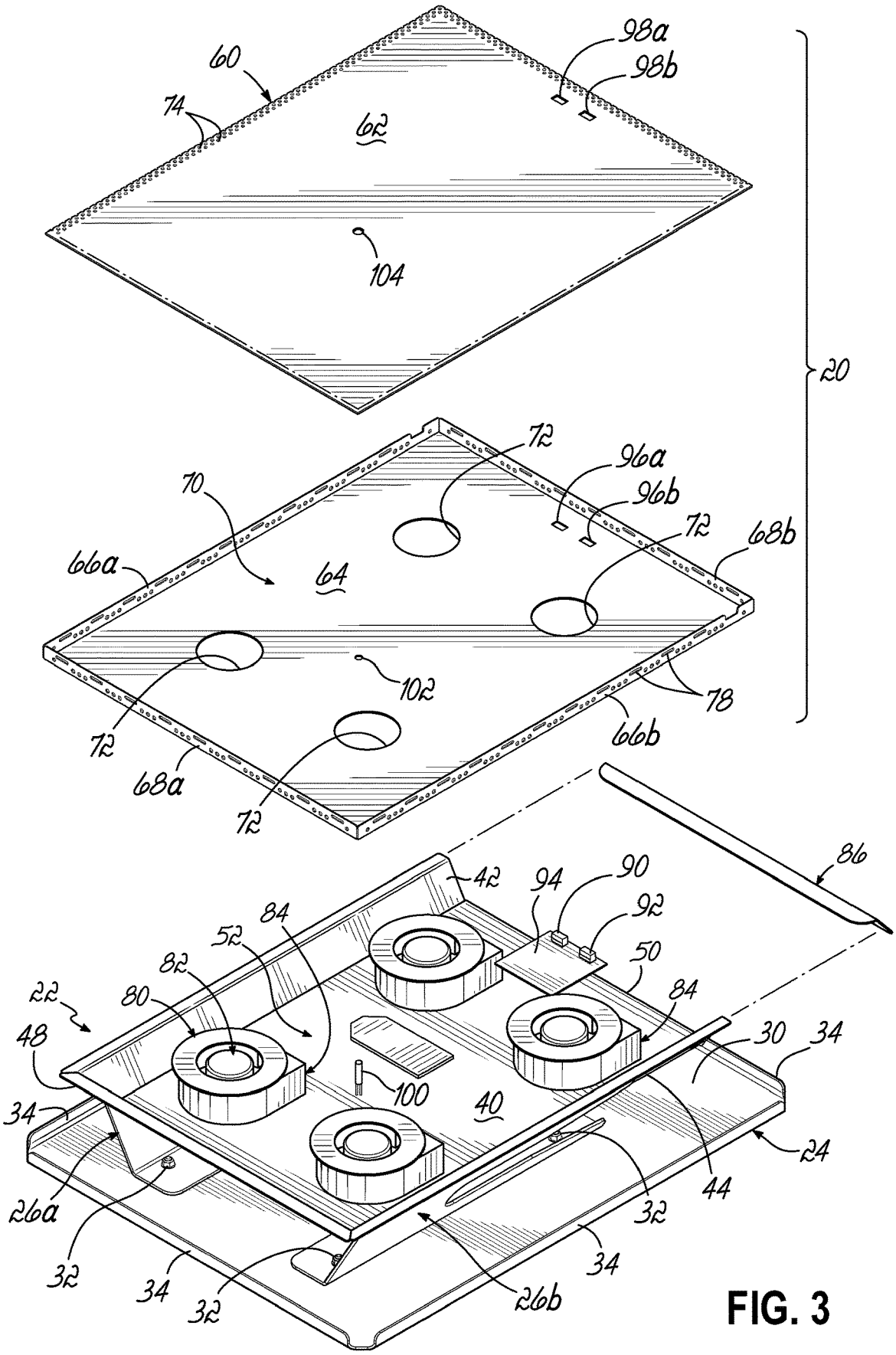
FIG. 3 is an exploded perspective view of the platen assembly of FIG. 2.
Figure 4:
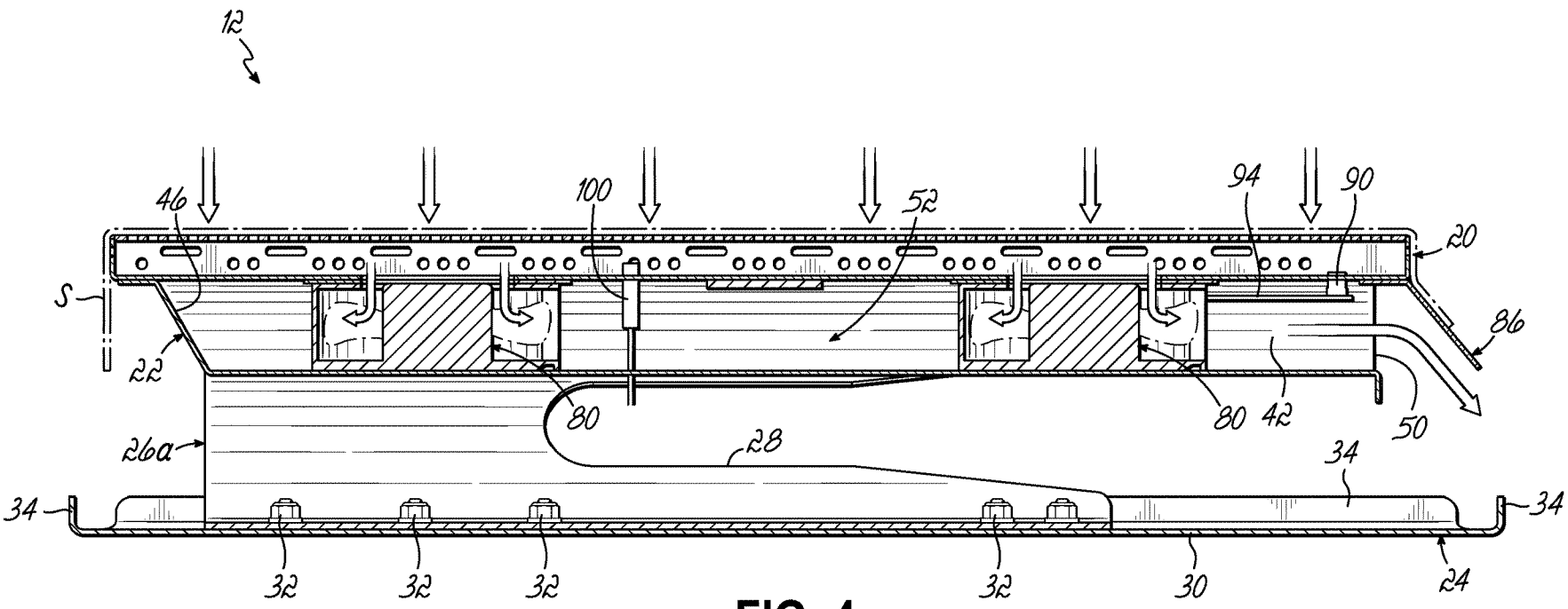
FIG. 4 is a cross-sectional view of the platen assembly of FIG. 2, taken along line 4-4.

With continued reference to FIGS. 3 and 4, the plenum assembly 22 includes a bottom wall 40 and first and second spaced apart sidewalls 42, 44 provided along opposite lateral edges of the bottom wall 40. An end wall 46 is disposed between the first and second sidewalls 42, 44 at a first end 48 of the plenum assembly 22 and opposite an open, second end 50. The substrate support 20 is disposed atop the plenum assembly 22, opposite the bottom wall 40, and engages the first and second sidewalls 42, 44 and the end wall 46 of the plenum assembly 22 to define a plenum 52 through which air drawn from the substrate support 20 flows toward the open end 50 as will be described more fully below.

The substrate support 20 includes a support plate 60 defining a generally planar support surface 62 upon which a substrate S may be received, and a bottom wall 64 spaced from the support plate 60. The substrate support 20 further includes first and second oppositely disposed sidewalls 66*a*, 66*b*, and first and second oppositely disposed end walls 68*a*, 68*b* provided along the peripheral edges of the bottom wall 64 and cooperating with the bottom wall 64 to define a vacuum chamber 70 beneath the support plate 60. One or more inlet openings 72 are provided in the bottom wall 64 of the substrate support 20, through which air is drawn into the plenum 52 to create vacuum pressure within the vacuum chamber 70 and a corresponding flow of air through apertures of the substrate support 20. In the embodiment shown in FIGS. 1-4, apertures of the substrate support 20 include a plurality of apertures 74 in the form of circular holes through the support plate 60. In the embodiment shown, the plurality of apertures 74 extend over the entire surface of the support plate 60. It will be appreciated, however, that apertures 74 in the support plate 60 may have a variety of other configurations. As nonlimiting examples, apertures 74 through the support plate 60 may have different shapes, such as slots, and may only be provided in selected portions of the support plate as may be desired to facilitate drawing a substrate S tightly against the support plate 60.

Figure 2:
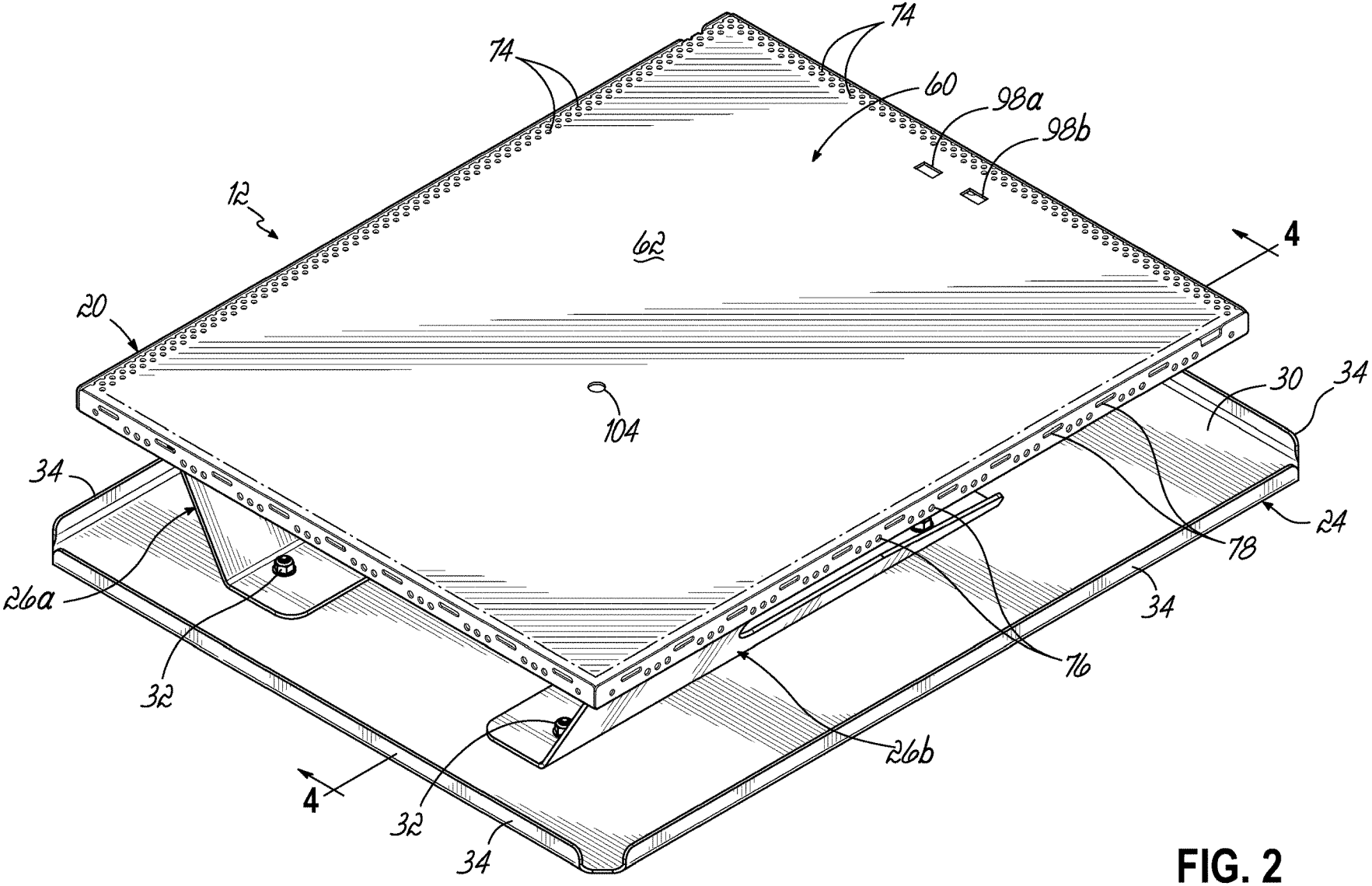
FIG. 2 is a perspective view of the exemplary platen assembly of FIG. 1.

In use, when a flexible substrate S, such as a textile material, is placed onto the substrate support 20, air flowing through the apertures 74 draws the substrate S tightly against the support plate 60 and secures the substrate S against movement during operation of the printer system 10 to apply inks and/or pretreatment liquids to the substrate S. In addition to, or as an alternative to the apertures 74 provided through the support plate 60, the substrate support 20 may further include apertures 76, 78 through one or more of the sidewalls 66*a*, 66*b* and end walls 68*a*, 68*b* of the substrate support 20 as depicted in FIGS. 2-4. Air flowing through these apertures 76, 78 will cause a substrate S to draw tightly against the surfaces of the sidewalls 66*a*, 66*b* and/or end walls 68*a*, 68*b*.

The platen assembly 12 further includes a vacuum device adapted to create vacuum pressure within the vacuum chamber and thereby cause a corresponding flow of air through the apertures 74, 76, 78 in the substrate support 20. In the embodiment shown, the vacuum device comprises a plurality of blowers 80 disposed within the plenum 52 and arranged such that inlets 82 to the blowers 80 are aligned with the inlet openings 72 in the bottom wall 64 of the substrate support 20. In use, operation of the blowers 80 draws air through the apertures 74, 76, 78 in the substrate support 20 into the vacuum chamber 70, and through the inlet openings 72 to the corresponding inlets 82 of the blowers 80. Air exits the blower outlets 84 into the plenum 52 and flows toward the open second end 50 to be discharged to the environment. A deflector plate 86 may be provided at the second end 50, as depicted in FIGS. 1, 3, and 4, to direct discharged air from the platen assembly 12 as may be desired. While this embodiment depicts blowers 80 disposed inside the plenum assembly 22, a vacuum device may alternatively be disposed outside the plenum assembly as may be desired. Moreover, while this embodiment depicts vacuum devices in the form of four blowers 80, it will be appreciated that a different number of blowers may alternatively be used, and that different vacuum devices suitable for creating vacuum pressure within the vacuum chamber 70 and causing a corresponding flow of air through the apertures 74, 76, 78 in the substrate support 20 may alternatively be used. Power may be provided to the platen assembly 12 from a power source by a wiring harness (not depicted) for operation of the blowers 80 and other components of the platen assembly 12 requiring electrical power.

In one embodiment, the vacuum pressure developed within the vacuum chamber 70 may be selectively adjustable to and between at least a first vacuum pressure and a second vacuum pressure of lower or higher magnitude than the first vacuum pressure. In this embodiment, the first vacuum pressure may be selected to facilitate securing a substrate S on the substrate support 20 prior to movement of the platen assembly 12 beneath the printer housing 16 to receive inks and/or pretreatment liquid. After the platen assembly 12 is moved to a position proximate the printer housing 16 for receiving inks and/or pretreatment liquid, the vacuum pressure may be switched to the second vacuum pressure. In one aspect, the second vacuum pressure may be selected to be a lower level of vacuum that is sufficient to maintain the position of the substrate S on the substrate support 20, but not so great so that the airflow through the apertures 74, 76, 78 caused by the second vacuum pressure interferes with the path of ink or pretreatment liquid droplets in flight between the printhead or nozzles and the substrate S. Nevertheless, because the second vacuum level still creates airflow through porous substrates S such as textile materials, ink and applied pretreatment liquid may be drawn into the porous material of the substrate S. The action of drawing the ink and/or pretreatment liquid into the substrate S provides benefits in terms of increased ink and pretreatment adhesion, as well as improved wash fastness of the finished product. Moreover, appropriate selection of the second vacuum level greatly reduces or eliminates overspray or airborne liquid from being deposited on internal components of the printer system 10 or into surrounding environment, as well as reducing or eliminating the bounce-back of ink or liquid from the substrate S during application. It has been found that proper selection of the second vacuum pressure is able to pull 100 percent of the ink or pretreatment liquid being applied onto the surface of the substrate S.

The air flow through porous substrates S such as textile materials also provides advantages when the platen assembly 12 is used in processes incorporating heat to dry and/or cure inks and pretreatment liquids applied to the substrates S. As a result of the airflow through the substrate S, higher temperatures may be applied to the substrate S without adversely affecting the inks, pretreatment liquids, or the substrate S. Accordingly, the platen assembly 12 provides increased control over moisture levels in the printed or treated substrate material. This is particularly advantageous when printing white ink onto substrates S, since airflow through the substrate material forces individual fibers of the substrate S to be fully coated with ink. Moreover, the vacuum pressure which draws the substrate S tightly to the substrate support 20 facilitates securing the substrate S against movement during printing and/or pretreatment, and also ensures that the material of the substrate S does not contract, expand, form wrinkles, or otherwise experience unwanted movement during the printing and/or pretreatment processes.

The vacuum pressure created by the blowers 80 or other vacuum devices may be controlled between the first and second vacuum pressures, as well as any level of vacuum pressure therebetween. Because different textile fabrics exhibit different degrees of porosity due to variations in consistency, density, weave pattern, and quality, the ability for air to flow through different textile materials also varies. Advantageously, the platen assembly 12 allows users to selectively adjust the level of vacuum pressure to correspond to a particular type of textile fabric which is to receive ink or pretreatment liquid, thereby controlling the air flow for optimization of the printing and pretreatment processes.

In one embodiment, the vacuum device, such as blowers 80, may be manually operated between on and off conditions, as well as any vacuum level between the first and second vacuum levels. In another embodiment, the platen assembly 12 may include sensors to detect the presence of a substrate S upon the substrate support 20 and to detect the position of the platen assembly 12 relative to the printer housing 16 to thereby control operation of the vacuum device. With reference to FIG. 3, the platen assembly 12 of the embodiment shown includes one or more sensors for detecting the presence of a substrate S on the substrate support 20. In this embodiment, first and second sensors 90, 92 are supported on a circuit board 94 disposed within the plenum assembly 22. Apertures 96*a*, 96*b*, 98*a*, 98*b* may be provided through the bottom wall 64 and support plate 60 of the substrate support 20, and aligned with the first and second substrate sensors 90, 92 to facilitate detecting the presence of a substrate S on the substrate support 20. In the embodiment shown, the first and second substrate sensors 90, 92 are retro-reflective optical sensors, such as Sharp® Digital Optical Sensors, available from Digi-Key Electronics, Thief River Falls, Minn. It will be appreciated, however, the various other sensors may be used that are suitable to detect the presence of a substrate S on the substrate support 20.

The platen assembly 12 may further include one or more sensors for sensing the position of the platen assembly 12 relative to the printer housing 16. In the embodiment shown, a position sensor 100 in the form of a magnetic read switch, such as ZF Electronics MP2017 Series Magnetic Reed Switch Sensors, available from Digi-Key Electronics, Thief River Falls, Minn., is disposed within the plenum assembly 22. It will be appreciated, however, that various other sensors suitable for sensing the position of the platen assembly 12 relative to the printer housing 16 may alternatively be used, and that positions sensors may be disposed at various other locations on the platen assembly 12 or the printer system 10 suitable for sensing the position of the platen assembly 12 relative to the printer housing 16. Corresponding apertures 102, 104 may be provided through the bottom wall 64 and support plate 60 of the substrate support 20, and aligned with the position sensor 100 to facilitate detecting the position of the platen assembly 12 relative to the printer housing 16.

In an exemplary embodiment, placement of a substrate S on the substrate support 20 is detected by the substrate sensors 90, 92, where after the blowers 80 may be controlled to operate at the first, high vacuum pressure to facilitate placement and securing the substrate S on the substrate support 20. When the substrate S is in position, the platen assembly 12 may be moved by the transport assembly 18 toward the printer housing 16. When the platen assembly 12 is in a desired position relative to the printer housing 16, the position sensor 100 detects the relative position of the printer housing 16. Upon detection of the desired position, the blowers 80 are switched to the second vacuum pressure level where after ink or pretreatment liquid may be applied to the substrate S. Operation of the sensors and blowers 80 may be controlled by the circuit board 94 or, alternatively, by a controller associated with the printer system 10. The platen assembly 12 may also be configured such that the substrate sensors 90, 92 detect the removal of the substrate S after the printing/pretreatment operation. Thereafter, when another substrate S is placed on the platen assembly 12, detection of the substrate S by the substrate sensors 90, 92 signals control of the blowers 80 to operate at the first vacuum level, thereby facilitating the placement and securing of the substrate S on the substrate support 20.

Figure 5:
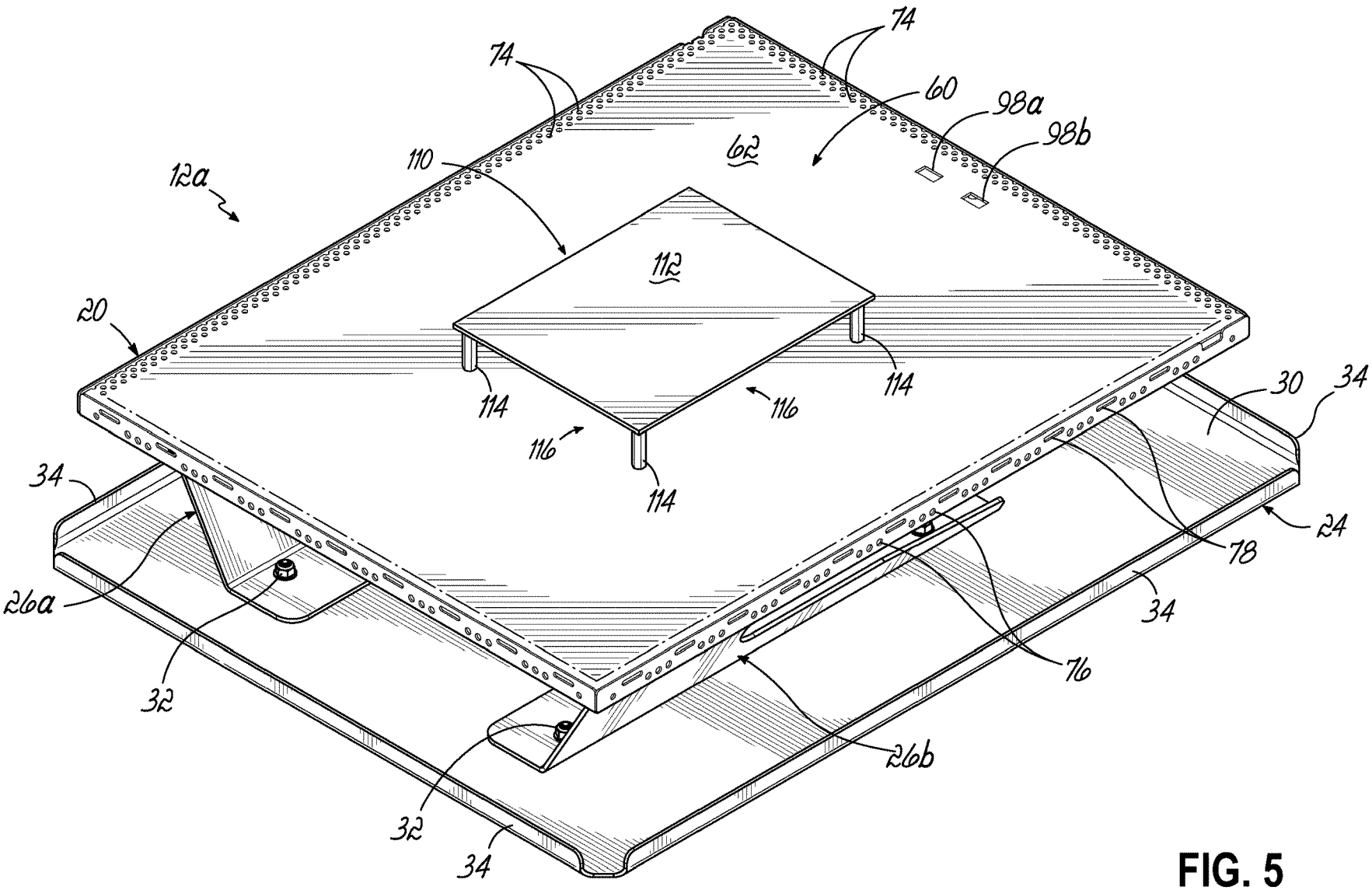
FIG. 5 is a perspective view of a second exemplary embodiment of a platen assembly in accordance with the principles of the present disclosure.

FIG. 5 depicts another exemplary embodiment of a platen assembly 12*a* in accordance with the principles of the present disclosure. Platen assembly 12*a* of FIG. 5 is similar to the platen assembly 12 described above with respect to FIG. 1-4, wherein similar features are similarly numbered. The platen assembly 12*a* further includes a riser 110 disposed above the support plate 60 and adapted to receive substrate materials of a small size or for which printing to a well-defined area is desired. The riser 110 includes a riser surface 112 defining a second planar area smaller than the planar area of the support plate 60. In the embodiment shown, the riser surface 112 comprises a generally flat plate supported above the support plate 60 by a plurality of spacers 114. One or more open spaces 116 are thereby defined between the riser surface 112 and the support plate 60. In use, when a substrate S is placed onto the substrate support 20, material of the substrate S contacting the support plate 60 is drawn tightly against the support plate 60 by vacuum pressure drawing airflow through the apertures 74 in the support plate 60 while portions of the substrate S adjacent the open spaces around the riser 110 are drawn into the open spaces 116 by airflow through the apertures 74 in the support plate 60 directly beneath the riser 110. This action draws the substrate S tightly against the riser surface 112 to facilitate the application of inks or pretreatment liquids to the substrate S positioned over the riser surface 112.

Figure 6:
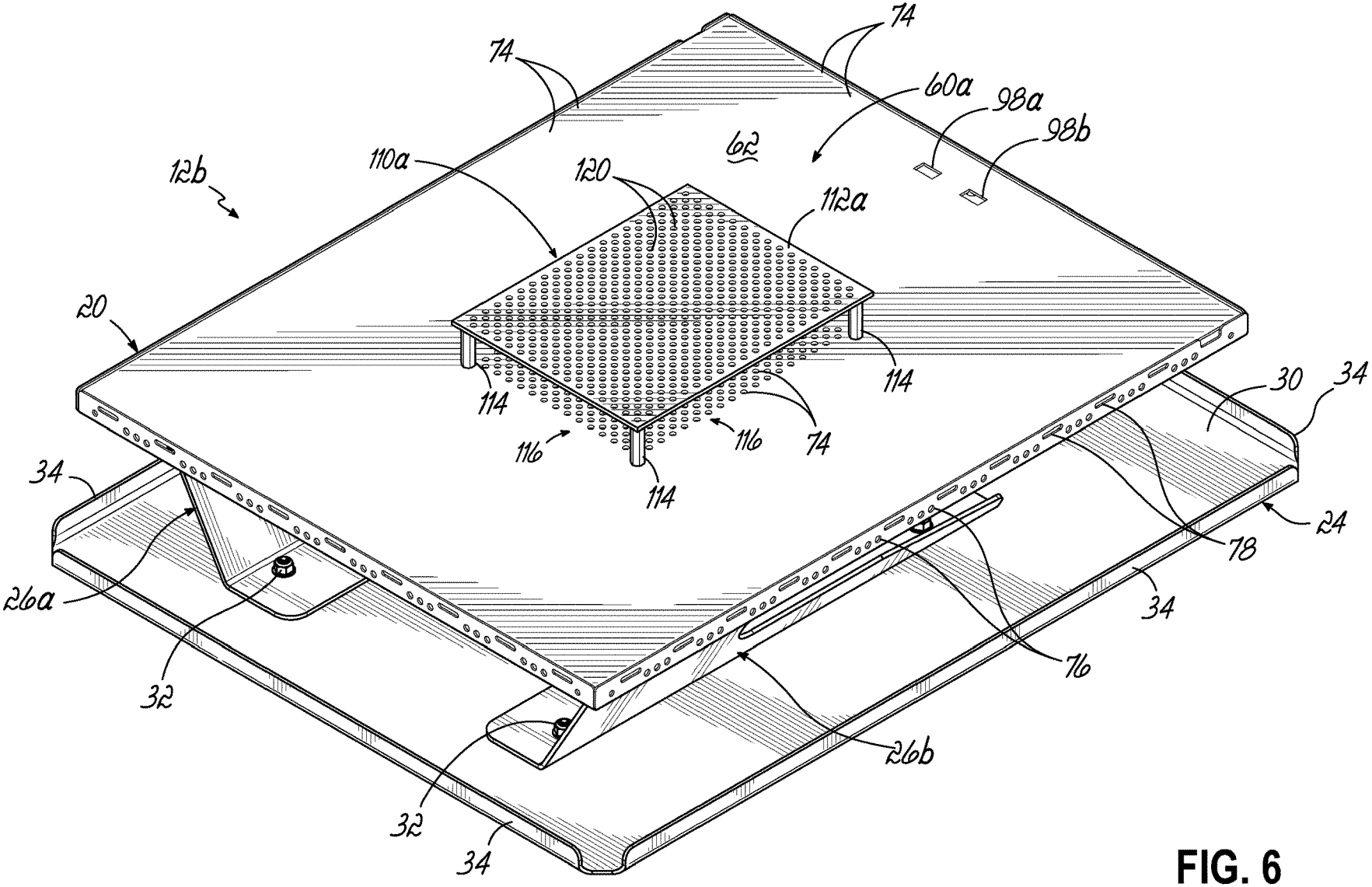
FIG. 6 is a perspective view of a third exemplary embodiment of a platen assembly, similar to the platen assembly of FIG. 5.

FIG. 6 depicts yet another exemplary embodiment of a platen assembly 12*b* similar to the platen assembly 12*a* of FIG. 5 and similar features are similarly numbered. In this embodiment, apertures 74 in the support plate 60*a* are only provided in a region of the support plate 60*a* that lies directly beneath the riser 110*a*, whereby air flow through the openings 116 between the riser 110*a* and the support plate 60*a* is increased in response to the vacuum pressure in the vacuum chamber 70. Apertures 120 may also be provided in the riser surface 112*a*, as may be desired, to increase the draw of the substrate S against the riser 110*a*. In one embodiment, the quantity and arrangement of apertures 74 through the support plate 60*a* may be varied by utilizing separate, removable support plates which may be removed and replaced over the vacuum chamber 70 to provide adjustment of the vacuum action acting on the substrate S. Alternatively, the quantity and arrangement of apertures 74 through the support plate 60*a* may be effectively varied by utilizing templates or masking plates of varying design to close off certain of the apertures 74 through the support plate 60*a*, while other apertures 74 remain exposed.

Figure 7:
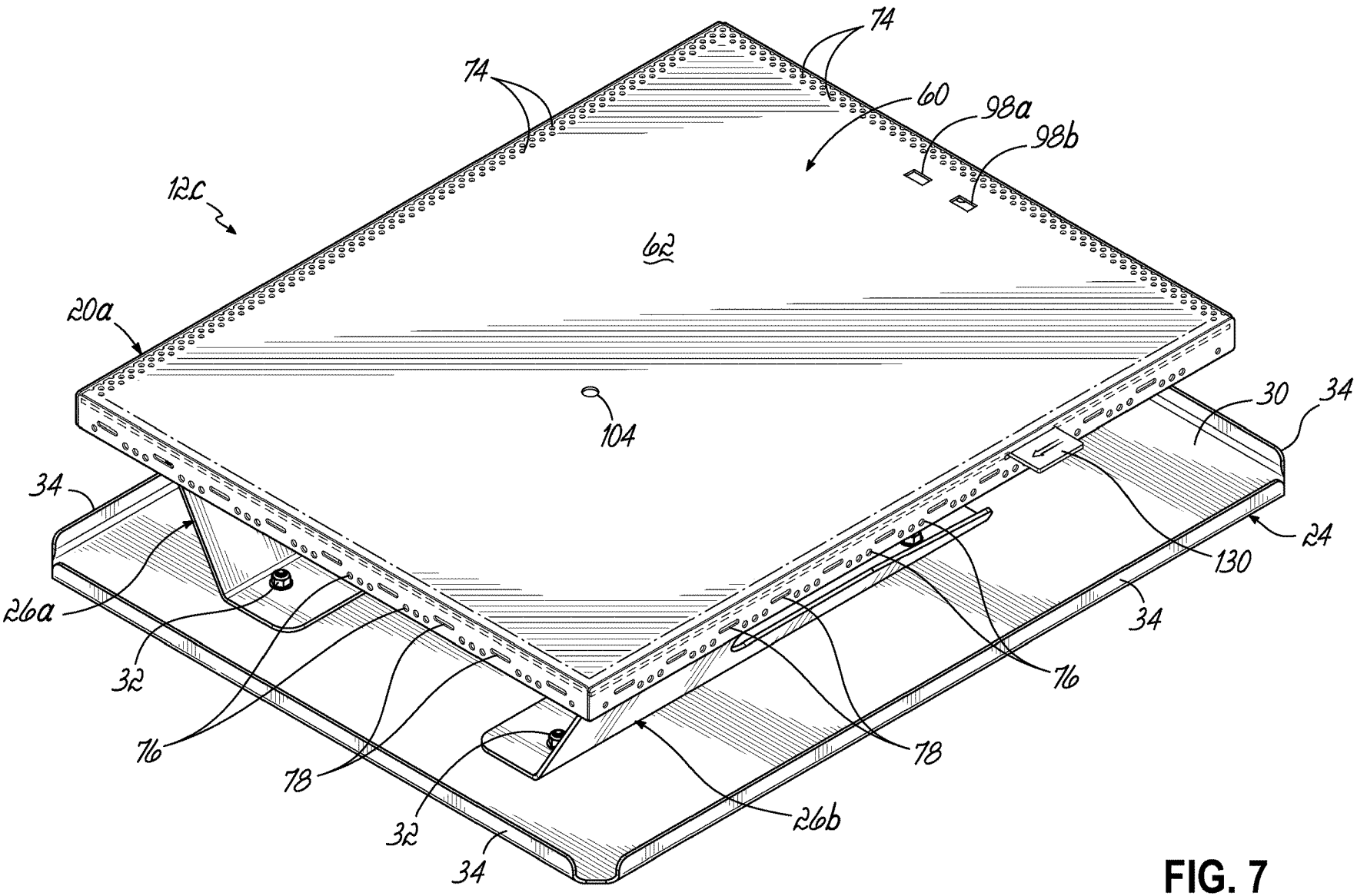
FIG. 7 is a perspective view of a fourth exemplary embodiment of a platen assembly in accordance with the principles of the present disclosure.

FIG. 7 depicts another exemplary platen assembly 12*c* in accordance with the principles of the present disclosure. Features of the platen assembly 12*c* of FIG. 7 are similar to the platen assembly 12 of FIGS. 2-4 discussed above and similar features are similarly numbered. In this embodiment, the platen assembly 12*c* further includes a selectively adjustable mechanism for varying the openings of one or more apertures 76, 78 in the first and second sidewalls 66*a*, 66*b* and/or first and second end walls 68*a*, 68*b* of the substrate support 20*a*. The openings may be varied by the mechanism between a fully open condition, a fully closed condition, and at least one condition intermediate the fully open and fully closed conditions. In the embodiment shown, the mechanism for varying the openings of the apertures 76, 78 comprises one or more plates disposed adjacent the sidewalls 66*a*, 66*b* or end walls 68*a*, 68*b* and having corresponding apertures therethrough. The plates are slidably adjustable by movement of a lever 130 to various positions along the length of the respective sidewall 66*a*, 66*b* or end wall 68*a*, 68*b* to vary the alignment of apertures in the plates with apertures 76, 78 in the sidewalls 66*a*, 66*b* or end walls 68*a*, 68*b* such that the effective openings through the apertures 76, 78 in the end walls 68*a*, 68*b* or sidewalls 66*a*, 66*b* are adjusted.

While the mechanism for varying the openings of apertures 76, 78 on the substrate support 20*a* has been shown and described herein as one or more slidably adjustable plates, it will be appreciated that various other mechanisms suitable for varying the effective openings of the apertures 76, 78 may alternatively be used.

Figure 8:
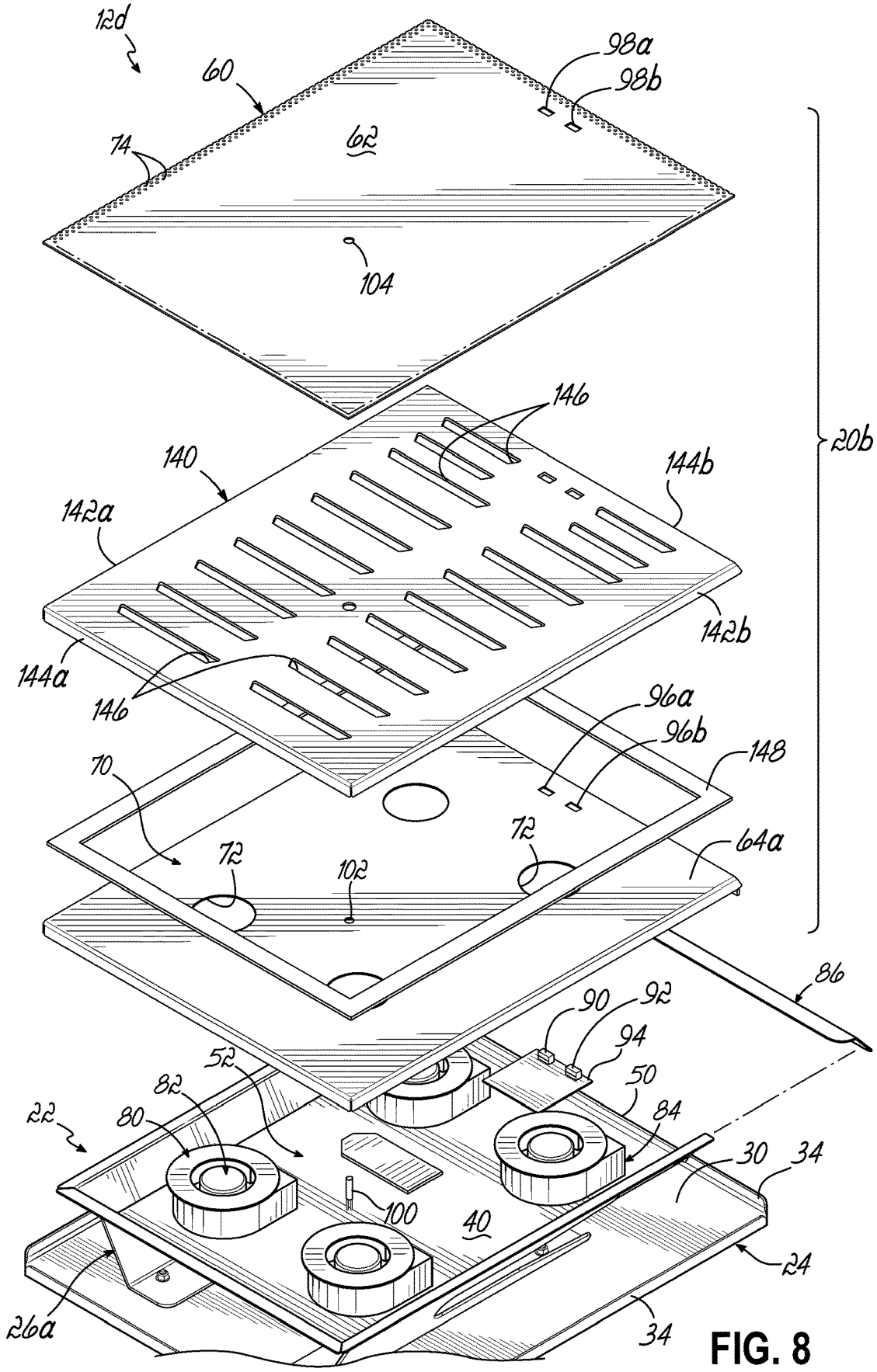
FIG. 8 is an exploded perspective view of a fifth exemplary embodiment of a platen assembly in accordance with the principles of the present disclosure.

Referring now to FIG. 8, another exemplary platen assembly 12*d* in accordance with the present disclosure is shown and described. The platen assembly 12*d* is similar in many aspects to the platen assembly 12 shown and described above with respect to FIGS. 1-4, wherein similar features are similarly numbered and differences between the platen assemblies 12, 12*d* are described herein. In this embodiment, the substrate assembly 20*b* comprises a support plate 60 and a bottom wall 64*a*, similar to substrate assembly 20 of FIGS. 3-4, and further includes an intermediate plate 140 disposed between the support plate 60 and the bottom wall 64*a*. The intermediate plate 140 includes oppositely disposed sidewalls 142*a*, 142*b* and end walls 144*a*, 144*b* that together with the bottom wall 64*a* define the vacuum chamber 70. A plurality of apertures 146, depicted herein as elongate slots, are formed through the intermediate plate 140 to provide fluid communication between the apertures 74 in the support plate 60 and the vacuum chamber 70. The substrate assembly 20*b* may further include spacers or stand-offs (not shown) disposed between the support plate 60 and the intermediate plate 140 to control a spacing therebetween, as may be desired, or to control the overall height of the platen assembly 12*d*. The substrate support 20*b* may further include a gasket 148 disposed between the intermediate plate 140 and the bottom wall 64*a*, and generally aligned with the sidewalls 142*a*, 142*b* and end walls 144*a*, 144*b* to provide a seal therebetween. Operation of the platen assembly 12*d* is otherwise similar to operation of the platen assembly 12 described above with respect to FIGS. 1-4.

Figure 9:
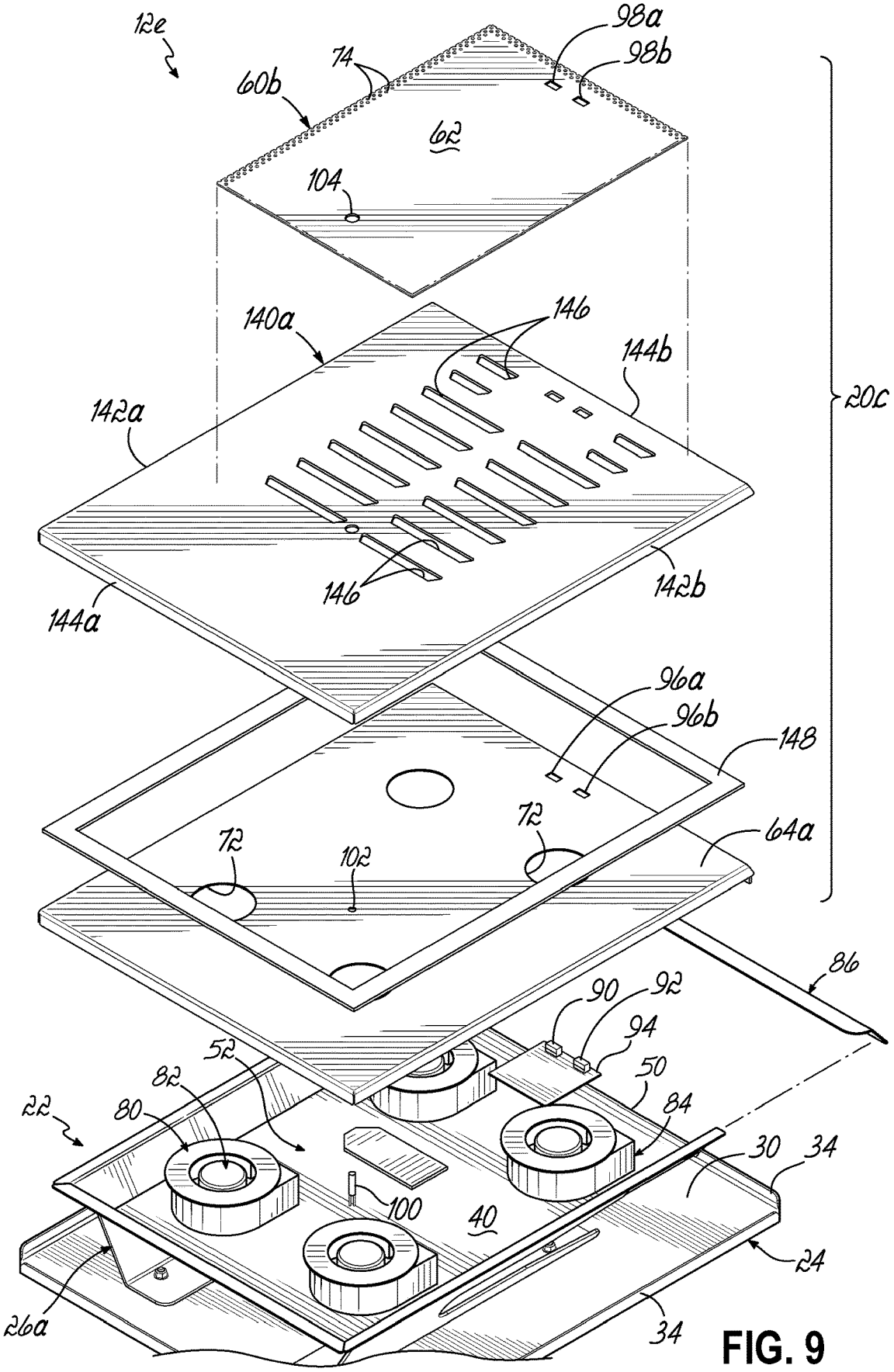
FIG. 9 is an exploded perspective view of a sixth exemplary embodiment of a platen assembly in accordance with the principles of the present disclosure.

Referring now to FIG. 9, another exemplary platen assembly 12*e* in accordance with the present disclosure is shown and described. The platen assembly 12*e* is similar to the platen assembly 12*d* shown and described above with respect to FIG. 8, wherein similar features are similarly numbered and differences between the platen assemblies 12*d*, 12*e* are described herein. In this embodiment, the apertures 146 in the form of elongate slots are provided on a portion of the intermediate plate 140*a* selected to correspond to a substrate S having a size that is generally smaller than the overall size of the top surface of the platen assembly 12*e*. In accordance with this embodiment, the support plate 60*b* may also have a size that is smaller compared to a support plate 60 that is sized to extend substantially over the entire top surface of the platen assembly 12*e* to thereby accommodate smaller sized substrates S or substrates wherein it is desired to print inks or apply pretreatment liquids to a well-defined area. The substrate assembly 20*c* may further include spacers or stand-offs (not shown) disposed between the support plate 60*b* and the intermediate plate 140*a* to control a spacing therebetween, as may be desired, or to control the overall height of the platen assembly 12*e*. Advantageously, the intermediate plate 140*a* and/or support plate 60*b* may be selectively interchanged with other intermediate plates or support plates of differing configuration to accommodate substrates S of various sizes or configurations.

While the present invention has been illustrated by a description of various embodiments, and while these embodiments have been described in considerable detail, it is not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit and scope of the general inventive concept.

What is claimed is:

1. A platen assembly for textile decorating machines and support equipment, the platen assembly comprising:

a substrate support adapted to support a textile substrate thereon to facilitate printing to the textile substrate;

one or more apertures associated with the substrate support;

a vacuum chamber in fluid communication with the one or more apertures; and a vacuum device operatively communicating with the vacuum chamber such that vacuum pressure is developed in the vacuum chamber during operation of the vacuum device and air flow is developed through the one or more apertures, whereby a controlled flow of air is directed through the textile substrate on the substrate support.

2. The platen assembly of claim 1, wherein the vacuum device comprises one or more blowers.

3. The platen assembly of claim 2, further comprising:

a plenum communicating with the vacuum chamber;

wherein the one or more blowers are disposed within the plenum.

4. The platen assembly of claim 1, wherein the substrate support comprises a support plate defining a support surface for receiving a substrate thereon, and the one or more apertures comprise a plurality of apertures through the support plate.

5. The platen assembly of claim 1, wherein the substrate support comprises:

a support plate defining support surface having a first planar area; and a riser disposed over the support plate, the riser including a riser surface defining a second planar area smaller than the first area;

wherein the one or more apertures comprise one or more open spaces between the riser surface and the support surface;

whereby vacuum pressure communicating with the one or more open spaces draws a substrate toward the open spaces.

6. The platen assembly of claim 1, wherein the substrate support comprises:

a support plate defining support surface having a first planar area; and at least one peripheral sidewall substantially perpendicular to the first planar surface;

wherein the one or more apertures comprise one or more apertures through the at least one peripheral sidewall.

7. The platen assembly of claim 6, wherein at least one of the one or more apertures through the at least one peripheral sidewall are selectively adjustable to vary an opening of the at least one aperture between a fully open condition, a fully closed condition, and at least one condition intermediate the fully open condition and the fully closed condition.

8. The platen assembly of claim 1, wherein the vacuum pressure developed in the vacuum chamber is selectively adjustable to and between at least a first pressure and a second pressure that is different than the first pressure.

9. The platen assembly of claim 8, wherein the first pressure is selected such that the textile substrate placed onto the substrate support will be drawn tightly against the substrate support.

10. The platen assembly of claim 9, wherein the first pressure is selected such that the textile substrate is further drawn against lateral sides of the substrate support.

11. The platen assembly of claim 8, wherein the second pressure is selected such that liquid material applied to the textile substrate on the substrate support will be drawn into the textile substrate, but the second pressure will not influence the placement of drops of the liquid material onto the textile substrate.

12. The platen assembly of claim 8, further comprising a sensor configured to detect a position of the platen assembly relative to a printer, the sensor operable to indicate when the vacuum pressure is to change between the first pressure and the second pressure.

13. A method of applying indicia to a textile substrate, the method comprising:

placing the textile substrate on a substrate support surface having a plurality of apertures; and directing a controlled flow of air through the textile substrate and the apertures such that the substrate is drawn against the substrate support.

14. The method of claim 13, further comprising:

selectively adjusting a level of air flow through the textile substrate between at least a first level and a second level different than the first level.

15. The method of claim 14, wherein the first level of air flow is selected such that the textile substrate is secured against movement on the substrate support surface.

16. The method of claim 14, wherein the second level of air flow is selected such that a path of liquid droplets directed toward the textile substrate is not affected by the air flow.

17. The method of claim 14, wherein at least one of the first level of air flow or second level of air flow is selected based on characteristics or properties of the textile substrate.

18. The method of claim 14, wherein the level of air flow through the textile substrate is based on a position of the substrate support surface relative to a device for printing or treating the textile substrate.

19. The method of claim 13, further comprising:

detecting the presence of the textile substrate on the substrate support surface; and controlling the flow of air through the textile substrate in response to the detected presence of the textile substrate.

20. The method of claim 13, further comprising drawing the substrate in a lateral and inward direction relative to a surface of the substrate to be decorated, using the air directed through the substrate.

21. A platen assembly for textile decorating machines and support equipment, the platen assembly comprising:

a substrate support adapted to support a textile substrate on a first planar surface thereof to facilitate printing to the textile substrate;

one or more apertures associated with the substrate support;

a vacuum chamber in fluid communication with the one or more apertures; and a vacuum device operatively communicating with the vacuum chamber such that vacuum pressure is developed in the vacuum chamber during operation of the vacuum device and air flow is developed through the one or more apertures;

wherein the substrate support comprises at least one sidewall at a periphery thereof, the at least one sidewall supporting the textile material on a on a second surface that is nonplanar with respect to the first planar surface; and wherein the one or more apertures comprise one or more apertures through the at least one sidewall.

* * * * *